United States Patent [19]

Krystal

[11] Patent Number: 5,012,532

[45] Date of Patent: May 7, 1991

[54] SIZE ADJUSTABLE CAP

[75] Inventor: Joseph Krystal, Downsview, Canada

[73] Assignee: Krystal Cap Company Ltd., Toronto, Canada

[21] Appl. No.: 360,279

[22] Filed: Jun. 2, 1989

[51] Int. Cl.[5] ..... A42B 1/22

[52] U.S. Cl. ..... 2/197; 2/195

[58] Field of Search ..... 2/196, 197, 171, 175, 2/182.1, 182.2, 182.6, 182.7, 183, 195, 209.3, 209.4, 209.5, 410, 417, 418, 419, 420

[56] References Cited

U.S. PATENT DOCUMENTS

| | | | |
|---|---|---|---|
| 1,156,487 | 10/1915 | Kunstadter | 2/197 |
| 1,194,193 | 8/1916 | Kronthal | 2/197 |
| 1,201,277 | 10/1916 | Dow | 2/195 |
| 1,648,551 | 11/1927 | Klein | 2/196 |
| 1,805,522 | 5/1931 | Horos | 2/197 |
| 2,698,945 | 1/1955 | Hamilton | 2/197 |
| 2,869,134 | 1/1959 | Milstein | 2/197 |
| 2,885,683 | 5/1959 | Lipkin | 2/197 |
| 3,035,273 | 5/1962 | Krystal | 2/197 |
| 3,247,523 | 4/1966 | Lipkin | 2/197 |
| 4,608,721 | 9/1986 | Lipkin | 2/197 |

FOREIGN PATENT DOCUMENTS

| | | | |
|---|---|---|---|
| 455612 | 4/1949 | Canada | 2/195 |
| 1054971 | 2/1954 | France | 2/197 |
| 1400477 | 4/1965 | France | 2/197 |
| 1408838 | 7/1965 | France | 2/197 |
| 1455860 | 9/1966 | France | 2/197 |
| 194748 | 12/1937 | Switzerland | 2/195 |
| 292451 | 6/1928 | United Kingdom | 2/197 |
| 512261 | 8/1939 | United Kingdom | 2/197 |

*Primary Examiner*—Peter Nerbun
*Assistant Examiner*—Diana L. Biefeld
*Attorney, Agent, or Firm*—Fetherstonhaugh & Co.

[57] ABSTRACT

A cap which is adjustable in size from a "small" size to an "extra large" size without destroying the aesthetics of the "Norwegian" or "Skilegion" design is provided by modifying the shape of the side panel. The side panel is shaped such that when laid-out flat the upper edge of the posterior portion extends along a shallow concave arc of curvature and the lower edge extends along a low convex arc of curvature. As a result of this configuration, the length of the upper and lower edges of the posterior portion is greater than length of the posterior portion of a conventional "small" size cap by an amount which is at least equal to the total size adjustment which the cap is required to accommodate. An elastic member is fastened at its opposite ends to spaced points on the posterior portion of the side panel, adjacent the lower edge thereof. The attachment points are spaced a sufficient distance from one another and the elastic member is sufficiently elastic to draw the posterior portion inwardly along its lower edge to reduce the length of the posterior portion to provide a first cap size and it is sufficiently extensible to permit the posterior portion of the cap to be expanded to provide a second cap size which is substantially larger than the first cap size.

9 Claims, 4 Drawing Sheets

SIZE ADJUSTABLE CAP

FIELD OF INVENTION

This invention relates to caps. In particular, this invention relates to a size adjustable cap commonly known as a "Norwegian" or "Skilegion" type.

DESCRIPTION OF PRIOR ART

In my prior U.S. Pat. No. 3,035,273, I described a cap which incorporates a knitted panel which serves to provide size adjustment. While this structure is very effective and is extensively used, the knitted material tends to retain water and this characteristic can make the cap uncomfortable to wear in cold, wet weather. Caps of this type are worn by outdoorsmen such as hunters who frequently encountered cold and wet weather.

There is, however, a considerable advantage to be derived from providing a cap which can be adjusted to fit all sizes because it greatly reduces the amount of stock which a retailer must carry.

When I initially attempted to manufacture a hat which was size adjustable so as to be worn both as a "small" size cap and as a "extra large" size cap, I fabricated the cap with side panels and tip panels which were proportioned to correspond to the proportions of the "extra large" size. A "small" cap size which is commonly referred to as a 6¾" cap has a head encircling portion which has a 6¾" diameter and a circumference of about 21¼". An "extra large" cap size is commonly referred to as a 7⅝" cap size and has a head encircling portion which has a diameter of 7⅝" and a circumference of about 24". As a result the difference between the circumference of the head encircling portion of a "small" cap size and that of an "extra large" cap size is about 2¾".

I found that if an elastic member is applied to the posterior portions of the "extra large" side panel, in an attempt to reduce the size of these panels to a "small" size, the distortion of the shape of the cap which occurs is such that the cap loses its aesthetically pleasing Norwegian style characteristics. When such a cap is worn as a "small" cap, it has the appearance of being exceedingly tall because the anterior portion appears to be excessively large.

In attempting to overcome this difficulty, I initially attempted to compromise by using side panels which were somewhat smaller than the side panels normally required by a "extra large" size cap. However, the result was that I produced a cap which was severely distorted when worn as a "extra large" cap.

SUMMARY OF THE INVENTION

I have found that it is possible to form a size adjustable Norwegian type cap in which there is little or no deviation from the conventional appearance of the cap resulting from the size adjustment by altering the shape of the posterior portions of the side panels to increase the length of the lower edge of the side panels without significantly increasing the front to back length of the posterior portions of the side panel. This lengthening of the lower edge of the side panels provides the additional length of material which can be gathered in order to effect the size reduction. I have also found that by changing the shape of the upper edge of the posterior portion, I can prevent an undesirable distortion of the back end of the cap resulting from the gathering of the lower edge of the posterior portion of the side panels.

It is an object of the present invention to provide a size adjustable cap which retains its characteristic Norwegian style through its full range of size adjustment.

It is a further object of the present invention to provide a size adjustable cap which is capable of providing adjustment between a "small" and a "extra large" size without significantly affecting the aesthetic characteristics of the cap.

According to one aspect of the present invention, there is provided in a cap of the type having a tip panel which has a front end and a back end, side panel means and a peak panel and wherein the side panel has a posterior portion which extends around the back of the cap and anterior portions which extend from opposite ends of the posterior portion to the front of the cap, the side panels also having an upper edge, a lower edge and a front edge, the improvement wherein, when said side panel is laid-out flat, the posterior portion is arcuate in shape and the upper edge thereof extends along a shallow concave arc of curvature and the lower edge extends along a low convex arc of curvature such that the length of the lower edge of the posterior portion is greater than the lengtl of the posterior portion of a standard "small" size cap by an amount which is at least equal to the total size adjustment which the cap is required to accommodate and wherein when the cap is assembled, an elastic member is fastened at its opposite ends to the posterior portion adjacent opposite ends thereof and adjacent the lower edge thereof, said points being spaced a sufficient distance from one another and said elastic member being sufficiently elastic to draw the posterior portions inwardly along said lower end to reduce the length of the posterior portion to provide a first cap size and being sufficiently extensible to permit the posterior portions of the cap to be expanded to provide a second cap size which is substantially larger than the first cap size.

BRIEF DESCRIPTION OF DRAWINGS

The invention will be more clearly understood after reference to the following detailed specification read in conjunction with the drawings wherein:

With reference to FIG. 1 of the drawings, the reference numeral 10 refers generally to a size adjustable cap constructed in accordance with an embodiment of the present invention.

Figure 3:
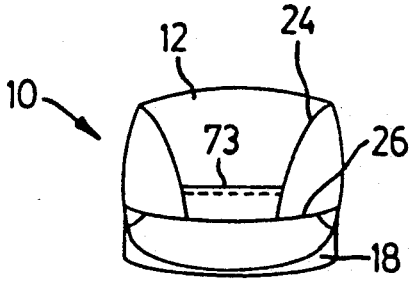
FIG. 3 is a front view of the cap of FIG. 1.

The cap 10 has tip panel 12, a side panel 14, a peak panel 16 and a cuff 18, all made from a fabric such as nylon, or a blend of polyester and cotton or the like which may be treated to be water-repellent.

The tip panel 12 is connected to the side panel 14 along a seamline 24. The peak 16 is connected to the tip panel 12 and side panel 14 along the seamline 26 (FIG. 3). The cuff 18 is connected to the side panel 14 along the seamline 28.

Figure 6:
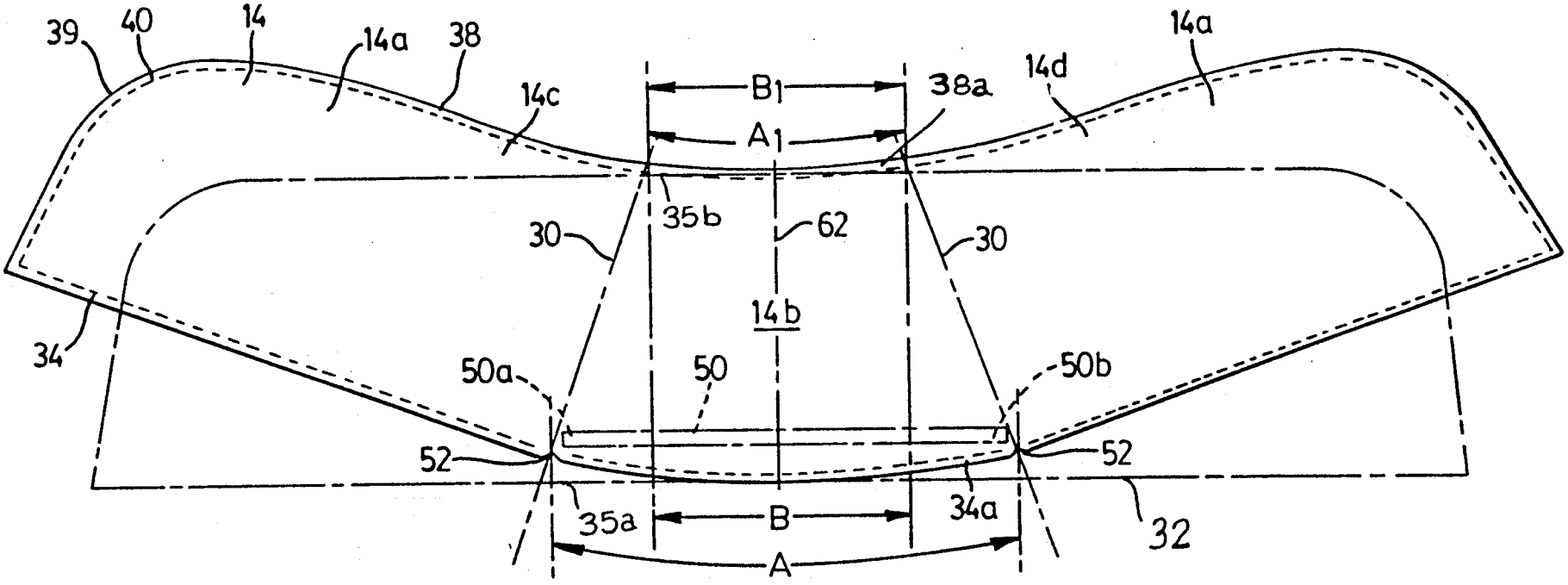
FIG. 6 is a plan view of a side panel in its laid-out flat configuration.

As shown in FIG. 6, the perimeter of the side panel 14 is defined by the stitch line 40, the margin 39 which extends outwardly from the stitch line 40 does not determine the proportions of the side panel when the cap is assembled and consequently all reference to upper edge, lower edge and back edge of the panel 14 refer to the edge which will be formed along the stitch line 40 when the cap is assembled and not the free edge of the panel 14.

Figure 1:
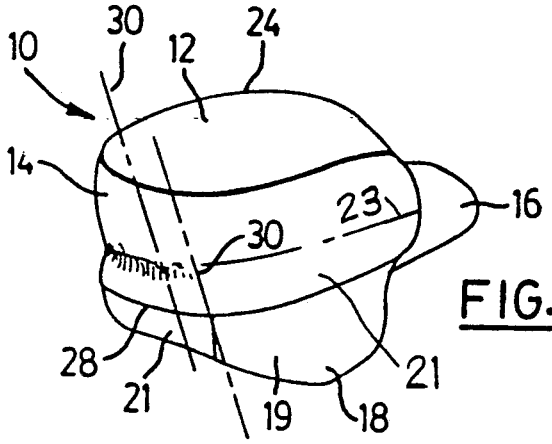
FIG. 1 is a pictorial view of a Norwegian-type cap constructed in accordance with an embodiment of the present invention.
Figure 2:
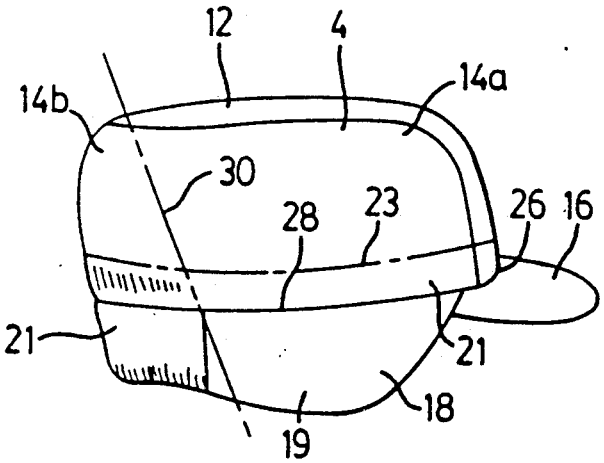
FIG. 2 is a side view of the cap of FIG. 1 in the expanded configuration.
Figure 4:
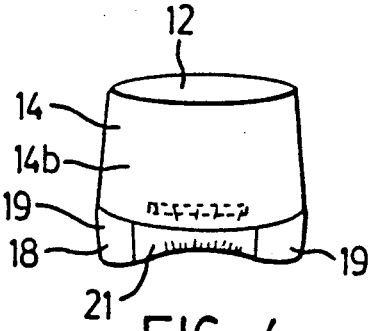
FIG. 4 is a back view of the cap of FIG. 1 in the contracted configuration.
Figure 5:
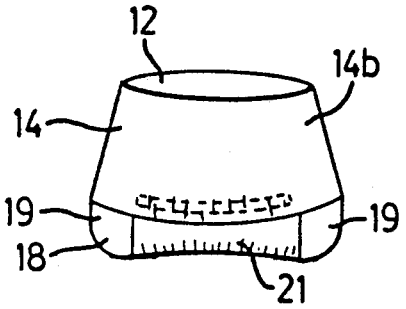
FIG. 5 is a back view similar to FIG. 4 showing the cap in the expanded configuration.

With reference to FIGS. 1 and 2 of the drawings, it will be seen that the side panel 14 has a posterior portion **14*b* which extends around the back of the cap between the lines 30 and anterior portions 14*a* which extend from the lines 30 to the front end of the cap. The posterior portion 14*b* provides the additional material which is added to a conventional side panel of a "small" size cap inorder to enlarge the head encircling portion 21 that extends from the seamline 28 to the broken line 23** to provide a size adjustment to fit an "extra large" size cap.

As shown in FIG. 6 of the drawings, the posterior portion **14*b* has an arcuate shape. Because of the arcuate shape of the posterior portion 14*b* the side panel 14 of the present invention is of a substantially different shape to the shape of a conventional posterior portion of a standard "extra large" size cap, the outline of which is shown by the chain line 32**.

The side panel 14 has a lower edge 34 and an upper edge 38. The portions of the upper and lower edges 34 and 38 which extend along the posterior portion **14*b* are identified by the reference numerals 34*a* and 38*a* respectively. For the purposes of comparison, the upper edge of the posterior portion of the conventional side panel is identified by the reference numeral 35*b* and its lower edge is identified by the reference numeral 35*a***.

As shown in FIG. 6 of the drawings, the posterior portion **14*b* and the adjacent portion of the upper edge of the anterior portions are curved such that the upper edge 38*a* extends in a shallow concave arc of curvature and the lower edge 34*a* extends in a low convex arc of curvature. The length of the upper edge 38*a* is identified by the dimension A1 and the length of the lower edge 34*a* is identified by the dimension A. The curvature of the posterior portion is such that the length A of the lower edge of the posterior portion is greater than the corresponding length of the posterior portion of the standard "small" size cap by an amount which is at least equal to the total size adjustment which the cap is required to provide. It falls that to provide size adjustment between a "small" size cap and an "extra large" cap size, the arcuate length A of the lower edge of the posterior portion must be greater than the length B by about 2¾". Two and three-quarter inches represents the difference between the circumference of the head encircling portion 23 of a "small" size cap and that of an "extra large" cap size. the upper edge 38*a* is proportioned so as to be greater than the length B1 of the upper edge 35*b* of the "small" size cap by an amount which will ensure that when the cap is drawn into the contracted size, the shape of the crown portion of the cap will not be deformed to an extent which will deviate significantly from the accepted contour of a "Norwegian" cap. The difference between the dimensions A1 and B1 is substantially less than that between A and B. I have found that if the arc of curvature of A1** extends parallel to that of A I can achieve the required "Norwegian" contour.

The cuff 18 comprises a pair of side panels 19 which are connected to one another by a posterior panel 21. The side panels 19 are of a conventional construction, however, the posterior panel 21 has an upper edge 23 which extends in a shallow concave arc of curvature. A band of elastic material is connected to the panel 21 along the lower edge thereof and serves to draw the cuff 18 inwardly to provide a snug fit around the back of the wearer in use.

The tip panel 12 (FIG. 7) has a front edge 46 and an outer edge 48. The outer edge 48 is shaped and proportioned to have a length which is equal to the length of the upper edge 38 of the side panel 14 to which it is attached. The tip panel 12 is folded along the fold lines 70, 71 and 72 to provide a convention tuck (FIG. 3).

Figure 7:
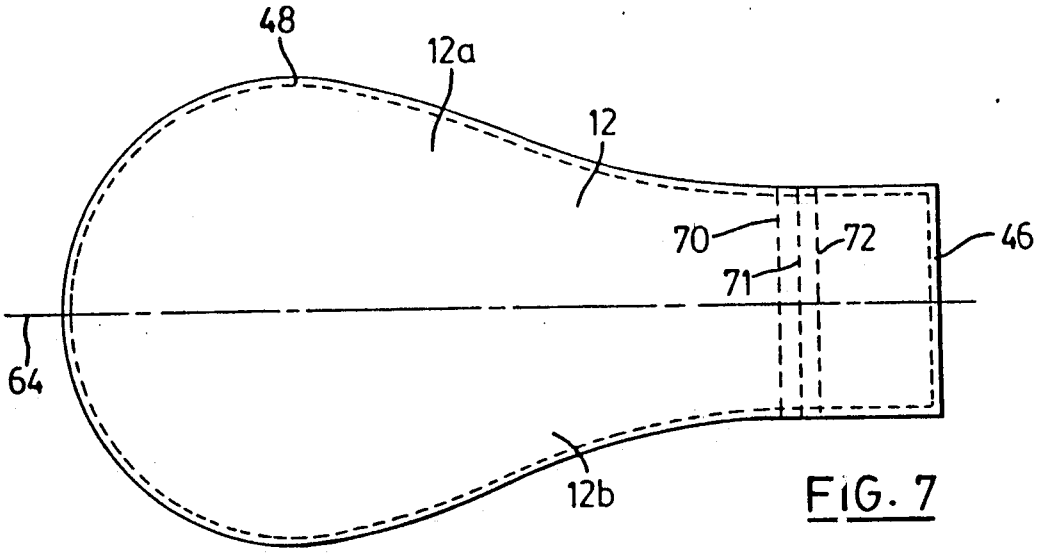
FIG. 7 is a plan view of a tip panel in its laid-out flat configuration.
Figure 8:
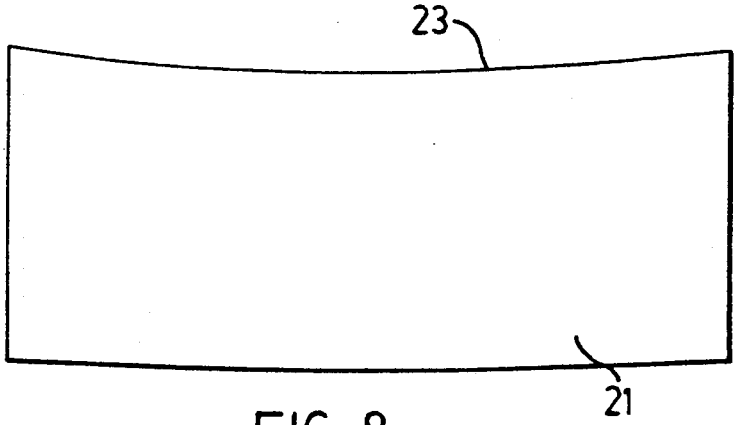
FIG. 8 is a plan view of a posterior cuff band.

In developing this contour of a side panel, I have used my skill as a designer of caps and I rely upon my ability to visualize the required arc of curvature with the result that I developed the curvature which the upper and lower edges of the posterior portion of the side panels follow by using my experienced eye and trial and error and consequently, I am not in a position to define the arc of curvature in precise mathematical terms. FIGS. 6, 7 and 8 of the drawings are, however, plan views which are drawn to scale which show the laid-out flat configuration of the side and tip panels. While FIGS. 6, 7 and 8 are drawn to scale, it should be understood that the proportions have been somewhat reduced for the purposes of illustration.

To assemble the cap a band 50 of an elastic material has its opposite ends **50*a* and 50*b* attached to the side panel 14 by stitching it to the side panel 14. The notchs 52 are provided along the lower edge 34*a* to give a visual aid to the operator to facilitate the identification of the point of attachment. It will be understood that because the band 50 is only attached at its opposite ends, it is not necessary to stretch the band while the band is being stitched in position. It should be noted, however, that the relaxed length of the band is preferably equal to about one half the length of the lower edge portion 34*a* which extends from the notch 52 of one side panel to the notch 52** of the other side panel.

The remainder of the sewing of the cap is consistent with the normal cap manufacturing procedure presently in use and will not, therefore, be described in detail. It will also be understood that a padded lining may be incorporated into the structure of the cap in a conventional manner. If a padded lining is used the padded lining may also incorporate side panels which are shaped in proportion to correspond to the side panels of the present invention described above.

Figure 9:
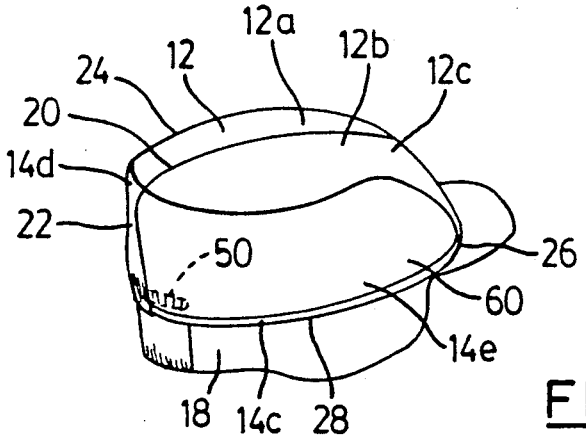
FIG. 9 is a pictorial view of a cap which has a reversible cover and which incorporates the size adjustment features.
Figure 10:
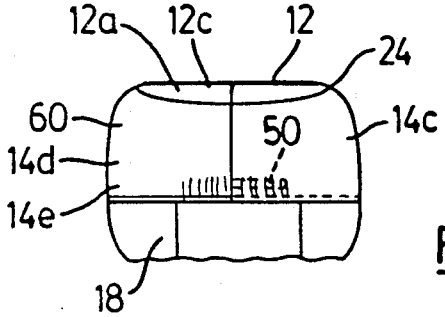
FIG. 10 is a back view of the cap of FIG. 9.

The cap of the present invention may also have a reversable cover 60 of the type which is commonly used in hunting caps in order to provide a bright easily detectable colour when turned inside out. The reversable cover panel 60 is illustrated in FIGS. 9 and 10 of the drawings. The reversable cover 60 includes a side panel **14*e* and a tip panel 12*c***.

To permit the reversable cover 60 to be attached to the cap the side panel 14 of FIG. 6 is replaced by side panels 14*c* and 14*d* which are shown in either side of the centre line 62. It will be apparent tat a suitable additional margin such as the margin 30 will be provided to permit these sub-panels to be attached to one another.

Figure 11:
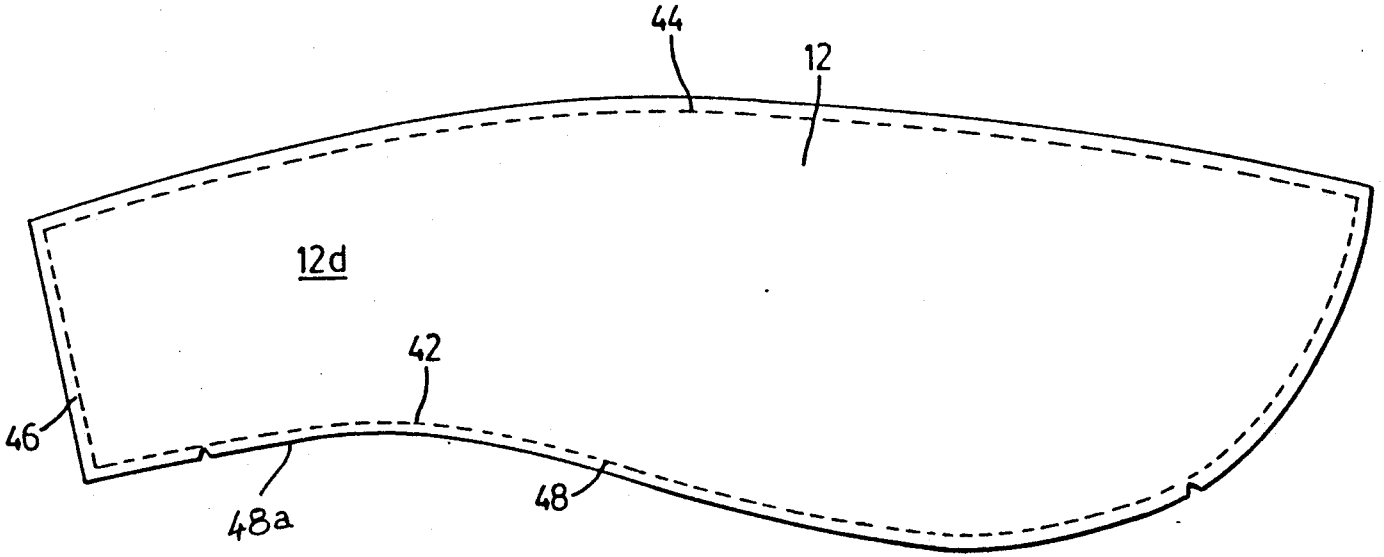
FIG. 11 is a plan view of a tip sub-panel suitable for use in a cap of the type illustrated in FIGS. 9 and 10 which has a reversable cover panel.

I have found that it is preferrable to design the tip sub-panels 12*a* and 12*b* so that they are not merely formed by splitting the tip panel 12 into two sections along the centre line 64 in FIG. 7. The preferred form of the sub-panels 12*a* and 12*b* is illustrated in FIG. 11 wherein it will be seen that the anterior portion 12*d* of the sub-panel 12*a* extends along a shallow arc of curvature such that the anterior portions of the sub-panels will diverge with respect to one another when laid out flat in a side-by side relationship. As shown in FIG. 11 the inner edge 44 extends along a low convex arc of curvature and the anterior portion 48*a* of the outer edge 48 extends along a shallow concave arc of curvature. It will also be noted that the back edge 46 is angularly inclined with respect to the longitudinal extent of the sub-panel 12*a*. I have found that when a cap is assembled using this type of tip sub-panel I can achieve a minimum amount of deviation from the classical contour of the Norwegian type cap when used in combination with a reversible cover panel. Again it should be noted that I have designed the preferred shape of the sub-panels 12*a* and 12*b* using my experienced eye and I have not developed a mathematical formula to define the shape of the curves which I employ. Again however FIG. 11 is drawn to scale although the size has been reduced for illustration purposes.

To assemble the cap the sub-panels 12*a* and 12*b* and the panel 12*c* are connected to one another along a seamline 20 (FIG. 9) which extends centrally of the width of the cap. The sub-panels 14*c* and 14*d* are connected to one another along a seamline 22 which is located centrally of the width of the back of the cap. The tip panels 12*a*, 12*b* are connected to the sub-panels 14*c* and 14*d* along seamlines 24. The peak 16 is connected to the tip panels 12*a* and 12*b* and sub-panels 14*c* and 14*d* along the seamline 26. The cuff 18 is connected to the sub-panels 14*c* and 14*d* along the seamline 28.

Unlike the panels 14*c* and 14*d*, however, the reversable cover 60 is not attached to the elastic member 50. The reversable cover 60 is attached along the seam lines 20 and 22. However, it is not attached along the seam line 28 with the result that the reversable cover 60 can be turned inside out by folding along the seam lines 20 and 22 so that it may be moved from the position shown in FIG. 9 of the drawings where it extends over the right hand side of the cap in the position shown in FIG. 10 of the drawings where it extends over the left hand side of the cap.

These and other modifications of the present invention will be apparent to those skilled in the art.

I claim:

1. A cap that has a head encircling portion which is adjustable in size between a first size and a second size that is larger than the first size by a predetermined amount that is sufficient to provide for adjustment between a first cap size and a second cap size, comprising; a tip panel which has a front end and a back end, a side panel and a peak panel, the side panel having a posterior portion which extends around and across the back of the cap and anterior portions which extend from opposite ends of the posterior portion to the front of the cap, the side panel also having an upper edge, a lower edge and a front edge and being shaped such that when said side panel is laid-out flat, the posterior portion is arcuate in shape and the upper edge thereof extends along a shallow concave arc of curvature and the lower edge extends along a convex arc of curvature, the arcuate length of the lower edge of the posterior portion being greater than the arcuate length of the upper edge of the posterior portion by an amount that is at least equal to said predetermined amount and wherein, when the cap is assembled, and elastic member is fastened at its opposite ends to spaced points on the posterior portion adjacent opposite ends thereof and adjacent the lower edge thereof, said spaced points being spaced a sufficient distance from one another and said elastic member being sufficiently elastic to draw the posterior portion inwardly along said lower edge to reduce the length of the lower edge of the posterior portion by said predetermined amount to provide the first cap size and being sufficiently extensible to permit the posterior portion of the cap to be expanded to provide the second cap size.

2. A cap as claimed in claim 1, wherein said first cap size is a $6\frac{3}{4}''$ cap size and said second cap size is a $7\frac{5}{8}''$ cap size.

3. A cap as claimed in claim 1, wherein the points at which the elastic member is attached to the posterior portion are spaced from one another to provide a 50% size reduction along the lower edge of the posterior portion when the elastic member is in a relaxed condition.

4. A cap as claimed in claim 1 wherein the side panel comprises two sub-panels which are connected to one another along a seam line which is located centrally of the posterior portion and extends between the upper and lower edge thereof, and the tip panel comprises two sub-panels which are connected to one another along a seam line which is located centrally of the width thereof and extends from the front end to the back end thereof and a reversible cover panel secured to the cap along said seam lines, said cover panel being otherwise free of attachment to the underlying posterior portions so as to be free to be folded along said seam lines to cover one or the other side of the cap.

5. A cap as claimed in claim 1, wherein the points at which the elastic member is attached to the side panels are spaced from one another to provide a 50% size reduction along the lower edge of the posterior portions when the elastic member is in a relaxed condition.

6. A cap as claimed in claim 1 wherein the arcuate length of the lower edge of the posterior portion is greater than the arcuate length of the upper edge of the posterior portion by about $2\frac{5}{8}''$ to permit size adjustment between a $6\frac{3}{4}''$ small cap size and a $7\frac{5}{8}''$ extra large cap size.

7. A cap that is adjustable in size between a first cap size and a second cap size that is larger than the first cap size by a predetermined amount, the cap comprising;

a pair of tip panels, a pair of side panels and a peak panel, each side panel having a front edge, a back edge, and anterior portion that extends from the front edge to a posterior portion that extends to the back edge, the posterior portions extending around the back end of the cap and being connected to one another centrally of the back of the cap, the side panels being shaped such that when the back edges thereof are connected and the side panels are laid-out flat, the posterior portions have a combined arcuate length that extends along an arcuate curve and wherein the combined arcuate length of the upper edges of the posterior portions is less than the combined arcuate length of the lower edges of the posterior portions by an amount that is at least equal to the difference in the length of a head encircling portion of caps having the first and second cap sizes.

8. A cap as claimed in claim 7, wherein said first cap size is a $6\frac{3}{4}''$ cap size and said second cap size is a $7\frac{5}{8}''$ cap size.

9. A cap as claimed in claim 7 wherein each tip panel has an inner edge, an outer edge and a back edge, the inner edges being juxtaposed when the tip panels are assembled, said tip panels when laid out flat prior to assembly, being shaped such that the inner edge thereof extends to assembly, being shaped such that the inner edge thereof extends along a low convex arc of curvature and the outer anterior portion of the outer edge extends along a shallow concave arc of curvature.

* * * * *